US006882816B2

(12) United States Patent
Tamai

(10) Patent No.: US 6,882,816 B2
(45) Date of Patent: Apr. 19, 2005

(54) DEVELOPING DEVICE WITH DEVELOPER CIRCULATING PATH

(75) Inventor: Yasutaka Tamai, Takaichi-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/368,267

(22) Filed: Feb. 18, 2003

(65) Prior Publication Data

US 2003/0156859 A1 Aug. 21, 2003

(30) Foreign Application Priority Data

Feb. 19, 2002 (JP) ..... 2002-041060

(51) Int. Cl.[7] ..... G03G 15/08

(52) U.S. Cl. ..... 399/254; 399/119; 399/256; 399/258

(58) Field of Search ..... 399/254, 258, 399/256, 265, 120, 359, 119

(56) References Cited

U.S. PATENT DOCUMENTS 4,163,614 A * 8/1979 Vock ..... 399/258
4,864,349 A * 9/1989 Ito ..... 399/256
5,436,703 A * 7/1995 DeYoung et al. ..... 399/256
5,510,882 A * 4/1996 Kikuta et al. ..... 399/258
5,717,973 A * 2/1998 Endoh et al. ..... 399/120
5,722,002 A * 2/1998 Kikuta et al. ..... 399/256

FOREIGN PATENT DOCUMENTS

JP 59-100471 6/1984
JP 10-239970 9/1998
JP 10239970 A * 9/1998 ..... G03G/15/08

* cited by examiner

*Primary Examiner*—Susan Lee
(74) *Attorney, Agent, or Firm*—Merchant & Gould P.C.

(57) ABSTRACT

A developer is carried to a developing region by a developer carrier and develops a static latent image formed on a latent image carrier. The developer to be supplied to the developer carrier is circulated in a first circulating path while being stirred. The developer also is circulated in a second circulating path. Here, at least a part of the first circulating path and at least a part of the second circulating path are common, intersect or contact each other. In a portion where both of the circulating paths are common, intersect or contact each other, a part of the developers in both of these paths are interchanged. In this manner, an image whose image density is uniform and stable can be obtained. Further, it is possible to achieve a small developing device that includes a long-life developer.

8 Claims, 8 Drawing Sheets

DEVELOPING DEVICE WITH DEVELOPER CIRCULATING PATH

BACKGROUND OF THE INVENTION

1. Field of the Invention

The present invention relates to a developing device used in image forming apparatus such as electrophotographic printers and copiers.

2. Description of Related Art

An example of a two-component system developing device used in a conventional electrophotographic image forming apparatus will be described referring to FIGS. 7 and 8. FIG. 7 is a schematic perspective view of the conventional developing device, and FIG. 8 is a sectional view taken along a line VIII—VIII and seen in an arrow direction in FIG. 7.

A developer carrier 1 is disposed so as to be in the vicinity of or in contact with a latent image carrier 6, which is not shown in FIG. 7. The developer carrier 1 includes a fixed magnet 1*b* having a plurality of magnetic poles therein and a developing roller 1*a* that is provided around the fixed magnet 1*b* and rotates in a direction of an arrow A. A two-component developer 2 containing a toner and a magnetic carrier is supplied to the perimeter surface of the developing roller 1*a*. The developer that is regulated to have a constant thickness by a regulating blade 5 and adheres to the surface of the developing roller 1*a* is carried to a developing region 30 by the rotation of the developing roller 1*a*.

In the developing region 30, a developing electric field generated by a bias voltage applied to the developing roller 1*a* allows a charged toner to move to the latent image carrier 6, so that a static latent image formed on the latent image carrier 6 is developed.

An electric field generated by the developed toner cancels out the developing electric field. Accordingly, when the amount of the toner adhering to the latent image carrier 6 increases so that the electric field thereof and the developing electric field balance out, the development ends at this point. Thus, since a toner with a high charge level generates a large electric field, the toner amount necessary for development is small, leading to a low image density. Conversely, since a toner with a low charge level generates a small electric field, the toner amount necessary for development is large, leading to a high image density.

The charge level of the toner in the developer increases in keeping with stirring time and reaches a certain saturation amount at a certain stirring time. A developer with a low toner concentration has a high charge level in saturation and thus achieves a low image density, whereas a developer with a high toner concentration has a low charge level in saturation and thus the toner easily stains the image or is scattered across the image. Accordingly, there has been a problem that insufficient or non-uniform stirring of the developer in the developing device causes concentration unevenness and charging unevenness of the toner, leading to unevenness and variation in the image density.

In order to solve this problem, a developing device is known in which a pair of stirring screws 3 and 4, between which a partition plate 8 is interposed, are provided as members for stirring the developer 2 as shown in FIGS. 7 and 8. The rotations of the stirring screws 3 and 4 respectively stir and carry the developer 2 along rotating-shaft directions indicated by arrows B and C, which are opposite to each other (see JP 10(1998)-239970 A, for example). At both ends of the rotating shafts, the partition plate 8 is cut out so as to form transfer regions 14 for the developer 2, and the developer 2 moves from one stirring screw to the other stirring screw, so that a path through which the developer 2 circulates is formed along both of the stirring screws 3 and 4. Since the developer 2 is stirred and charged while being carried through the circulating path, the developer 2 that is supplied from the stirring screw 3 to the developing roller 1*a* is supposed to achieve a uniform image with a constant density. Further, replacement toner in an amount that is as much as the toner consumed for development is newly supplied to the circulating path and stirred with the developer remaining in the circulating path. Thus, the developer maintains a constant toner concentration and a constant charge level, and a stable image is supposed to be obtained.

However, in an image forming apparatus that has been made smaller and thinner as a whole and a color printer including plural developing devices, a space that a developing device can occupy has become limited. Accordingly, the size of the developing device and the amount of the developer that can be put therein have been reduced. Consequently, there has been a problem that the developer is deteriorated in a short period of time, making it necessary to replace the developer in the developing device or the developing device itself frequently.

In order to extend the lifetime of the developing device, a technology called "trickle" is known, in which a certain proportion of the developer always is discharged from the developing device and a corresponding amount of the developer is newly supplied to the developing device. However, this technique is inefficient because the developer that is still usable also is discharged and thrown away, and the necessary amount of the developer increases, leading to a cost increase.

SUMMARY OF THE INVENTION

With the foregoing in mind, it is an object of the present invention to provide a small and low-cost developing device that includes a long-life developer and can achieve a uniform and stable image without unevenness or variation in its density.

In order to achieve the above-mentioned object, a developing device of the present invention includes a developer carrier that supports and carries a developer to a developing region for developing a static latent image on a latent image carrier, a first circulating path for carrying and supplying the developer to the developer carrier, and a second circulating path for carrying the developer. At least a part of the first circulating path and at least a part of the second circulating path are common, intersect or contact each other.

DESCRIPTION OF THE PREFERRED EMBODIMENTS

Figure 1:
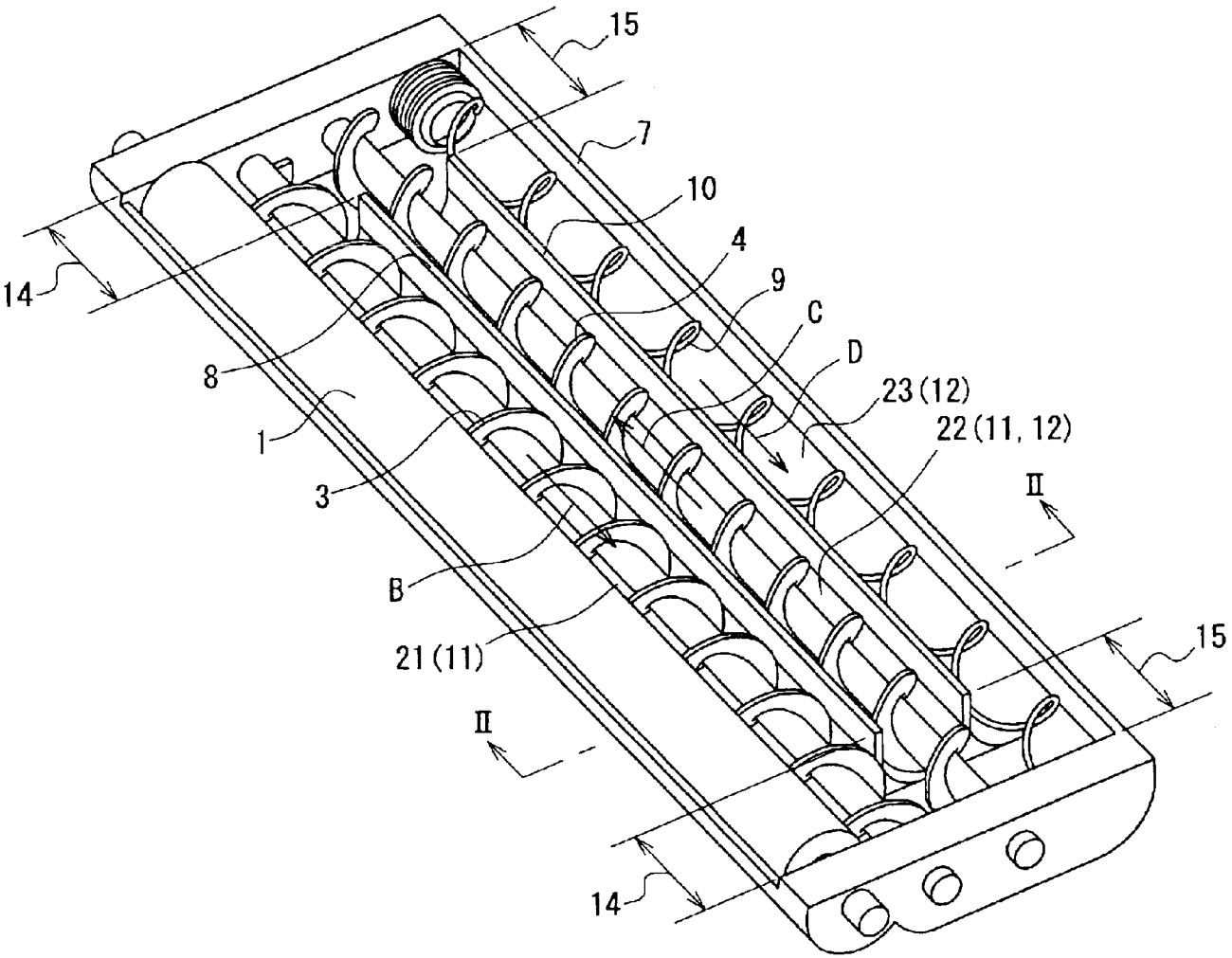
FIG. 1 is a schematic perspective view showing a developing device according to a first embodiment of the present invention.

A developing device of the present invention has a first circulating path for carrying and supplying the developer to the developer carrier, and a second circulating path for carrying the developer. At least a part of the first circulating path and at least a part of the second circulating path are common, intersect or contact each other.

This stabilizes stirring and carrying of the developer, so that a stable image with a uniform image density can be obtained. Moreover, as long as a part of the first circulating path and a part of the second circulating path are common, intersect or contact each other, the arrangement of the second circulating path is not limited in any way but can be designed freely. Accordingly, by providing the second circulating path in an unoccupied space in an image forming apparatus, it becomes possible to increase an amount of the developer easily without affecting the size and configuration of the entire apparatus. As a result, a small developing device including a long-life developer can be achieved.

In the above-described developing device of the present invention, it is preferable that the developer carrier has a roller shape, a first carrier passage and a second carrier passage that are substantially parallel with a longitudinal direction of the developer carrier are provided in this order from a side of the developer carrier, the developer carrier is disposed in the first carrier passage, and the first circulating path includes the first carrier passage and the second carrier passage. With this preferable configuration, it is possible to reduce the size of the first circulating path, thereby preventing the entire image forming apparatus from becoming bulky due to the developing device of the present invention.

In this preferable configuration, it is preferable that a place where the at least a part of the first circulating path and the at least a part of the second circulating path are common, intersect or contact each other is in the second carrier passage. With this preferable configuration, in the part of the second carrier passage where the first circulating path and the second circulating path are common, intersect or contact each other, a part of the developer circulating through the first circulating path and a part of the developer circulating through the second circulating path are interchanged. Since this partially interchanged developer in the first circulating path is stirred until it reaches the first carrier passage in which the developer carrier is disposed, a composition of the developer in the longitudinal direction of the developer carrier becomes uniform. Consequently, a stable image with a uniform image density can be obtained.

Also, in the above-described developing device of the present invention, it is preferable that the at least a part of the first circulating path and the at least a part of the second circulating path are common, and the developer carrier is disposed along a path other than a common path of the first circulating path that is shared with the second circulating path. The above-mentioned JP 10-239970 A describes a developing device in which the developer carrier is disposed along a common path shared by a first circulating path and a second circulating path. Such a configuration is likely to cause nonuniformity of a toner concentration in the developer in the longitudinal direction of the developer carrier. Furthermore, since a large amount of the developer flows in the common path, the regulating blade 5 for regulating the thickness of a developer layer on the developer carrier scrapes a large amount of the developer off the developer carrier. At this time, the developer is subjected to a considerable pressure from the regulating blade 5, so that the developer deteriorates rapidly. On the other hand, with the above-described preferable configuration, since the developer carrier is disposed along the path other than the common path of the first circulating path that is shared with the second circulating path, such a problem does not arise. In other words, the toner concentration in the developer in the longitudinal direction of the developer carrier is made uniform, making it possible to obtain a stable image with a uniform image density. Moreover, the deterioration of the developer is suppressed, thus extending its lifetime.

Furthermore, in the above-described developing device of the present invention, it is preferable that a carried amount of the developer in the first circulating path is larger than that in the second circulating path. Here, the carried amount of the developer refers to a weight of the developer that is carried per unit time. This preferable configuration makes it possible to suppress the amount of the developer that is interchanged between the first circulating path and the second circulating path, thereby preventing the variation of the toner concentration of the developer in the first circulating path. Further, it is possible to reduce a driving energy for stirring and carrying the developer in the second circulating path.

Also, in the above-described developing device of the present invention, it is preferable that a developer container is provided in the second circulating path. With this preferable configuration, the amount of the developer increases, thus extending the lifetime of the developer.

In this preferable configuration, it is preferable that the developer container is replaceable. This allows an extremely easy replacement of the developer.

In the following, the present invention will be described more specifically by way of embodiments.

First Embodiment

Figure 2:
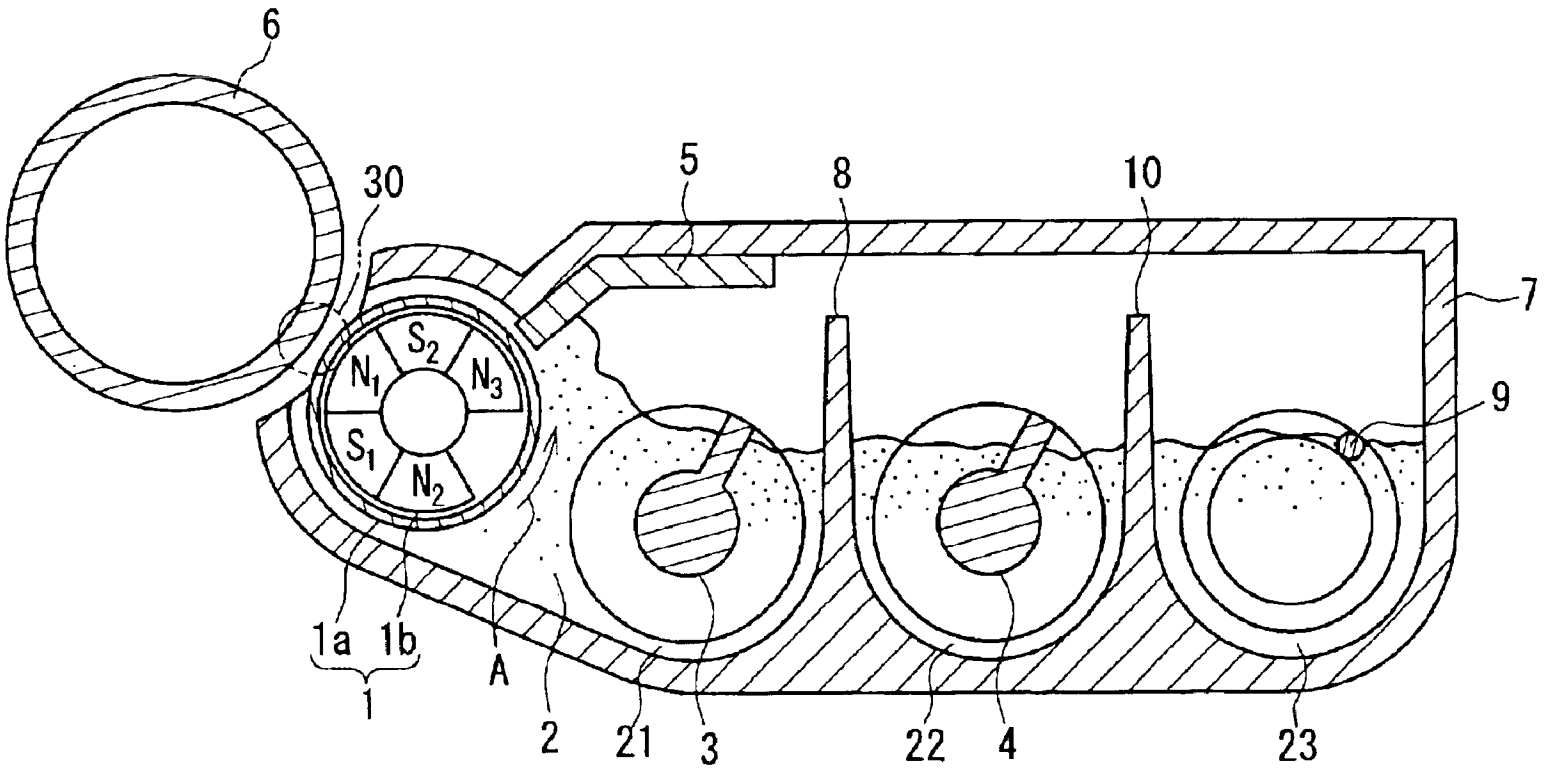
FIG. 2 is a sectional view, taken along a line II—II and seen in an arrow direction in FIG. 1, showing the developing device according to the first embodiment of the present invention.

FIG. 1 is a schematic perspective view of a developing device according to a first embodiment of the present invention. FIG. 2 is a sectional view, taken along a line II—II and seen in an arrow direction, of the developing device shown in FIG. 1.

A developer carrier 1 includes a fixed magnet 1*b*, in which five magnetic poles, namely, an attracting magnetic pole N3, a carrier magnetic pole S2, a developing magnetic pole N1, a carrier magnetic pole S1 and a releasing magnetic pole N2 are arranged in this order, and a developing roller 1*a* that is provided outside the fixed magnet 1*b* and rotates in a direction of an arrow A. The developer carrier 1 supports and carries a developer 2 by a rotation of the developing roller 1*a*. The attracting magnetic pole N3 that has the same polarity as the releasing magnetic pole N2 is arranged at a certain distance from the releasing magnetic pole N2. The releasing magnetic pole N2 and the attracting magnetic pole N3 have the same polarity, so that no magnetic field is formed on the surface of the developing roller 1*a* between them. The developing roller 1*a* may have an outer diameter of $\phi 12$ and be formed of an aluminum sleeve whose surface is provided with several-μm roughness. With respect to the fixed magnet 1*b* inside, the developing magnetic pole N1 may have a magnetic force of 95 mT and the other magnetic poles may have a magnetic force of 60 mT.

The developer 2 is obtained by mixing a magnetic carrier and a toner in a certain ratio. The magnetic carrier may be ferrite particles whose surfaces are coated with resin and have a mean particle diameter of 35 μm, whereas the toner may be particles formed of a polyester resin or the like and have a mean particle diameter of 7 μm.

As a regulating member for regulating the thickness of the developer 2 layer on the developer carrier 1, a regulating blade 5 is disposed downstream of the stirring members along a rotating direction of the developing roller 1*a* (indicated by the arrow A) so as to keep a 0.3 mm distance from the developer carrier 1. The regulating blade 5 may be formed of an aluminum plate with a thickness of 2 mm.

As the members for stirring the developer, two stirring screws 3 and 4 having an outer diameter of 12 mm and a pitch of 15 mm are arranged inside a developing case 7 in such a manner as to be in parallel with the developer carrier 1. A partition plate 8 that may be formed as one piece with the developing case 7 and partitions the developer 2 is provided between both of the stirring screws 3 and 4. The stirring screws 3 and 4 are rotated at the same rotational speed by a driving portion (not shown), thereby stirring and carrying the developer 2 along rotating-shaft directions indicated by arrows B and C, which are opposite to each other. In portions corresponding to both ends of the stirring screws 3 and 4, the partition plate 8 is cut out so as to form transfer regions 14. The developer 2 can be transferred between the stirring screws 3 and 4 through these transfer regions 14. As a result, a first carrier passage 21 in which the stirring screw 3 stirs and carries the developer 2 in the direction of the arrow B is formed between the partition plate 8 and the developer carrier 1, whereas a second carrier passage 22 in which the stirring screw 4 stirs and carries the developer 2 in the direction of the arrow C is formed between the partition plate 8 and a partition plate 10. Both ends of the first carrier passage 21 and the second carrier passage 22 are connected at the transfer regions 14, thereby forming a first circulating path 11 for circulating the developer 2 in the direction indicated by the arrows B and C while stirring it.

Furthermore, a stirring coil 9 is provided in parallel with the stirring screw 4 and on the other side of the partition plate 10, which may be formed as one piece with the developing case 7. The stirring coil 9 rotates and carries the developer 2 in a direction of an arrow D, which points opposite from the arrow C indicating the carrying direction of the stirring screw 4. Both ends of the partition plate 10 between the stirring coil 9 and the stirring screw 4 also are cut out so as to form transfer regions 15. The developer 2 can be transferred between the stirring screw 4 and the stirring coil 9 through these transfer regions 15. As a result, a third carrier passage 23 in which the stirring coil 9 stirs and carries the developer 2 in the direction of the arrow D is formed between the partition plate 10 and an inner wall of the developing case 7. Both ends of the second carrier passage 22 and the third carrier passage 23 are connected at the transfer regions 15, thereby forming a second circulating path 12 for circulating the developer 2 in the direction indicated by the arrows C and D while stirring it.

The stirring coil 9 may have a spiral coil with an outer diameter of 12 mm, a line width of 1.2 mm and a pitch of 15 mm and be rotated by a driving portion (not shown) at a rotational speed (rpm) that is 1/20 of that of the stirring screw 4.

In the present embodiment, the first circulating path 11 and the second circulating path 12 share the common second carrier passage 22 in which the stirring screw 4 is disposed. The toner is supplied to the first circulating path 11 by a toner supply means, which is not shown in the figure.

The developer 2 that has been stirred and carried through the first circulating path 11 is supplied from the stirring screw 3 to the developer carrier 1 by the magnetic force of the attracting magnetic pole N3 of the developer carrier 1. The developer 2 supplied to the developer carrier 1 is carried in the direction of the arrow A by the rotation of the developing roller 1*a*, its thickness being regulated by the regulating blade 5, and then the developer 2 is carried to a developing region 30. In the developing region 30, a developing electric field generated by a bias voltage applied to the developing roller 1*a* allows the toner to move to a latent image carrier 6 (not shown in FIG. 1), so that a static latent image formed on the latent image carrier 6 is developed. Thereafter, the developer is moved from the developer carrier 1 to the stirring screw 3 by the releasing magnetic pole N2, mixed with the developer that has not been used for development and stirred and carried in the first circulating path 11.

Also, an amount of toner corresponding to that consumed for development in the developing region 30 is newly supplied to the first circulating path 11 by a toner concentration detection means and the toner supply means, which are not shown in the figure, and mixed and stirred with the developer. Thus, the toner concentration and charge level of the developer 2 can be kept constant.

In this manner, the developer 2 is supplied from the stirring screw 3 to the developer carrier 1 successively, and after the development the developer is stirred and carried again. Consequently, the developer 2 that has a constant concentration and is constantly charged is always supplied to the developing region 30, thus obtaining a stable image.

Furthermore, the developer 2 is stirred and carried also in the second circulating path 12, so that the developer in the first circulating path 11 and that of the second circulating path 12 are mixed in the common second carrier passage 22 having the stirring screw 4 therein. Then, a part of the developer in the first circulating path 11 moves to the second circulating path 12, whereas a part of the developer in the second circulating path 12 moves to the first circulating path 11, whereby the developers are interchanged.

Thus, a part of the first circulating path 11 and a part of the second circulating path 12 share the common passage, whereby not only the developer in the first circulating path 11 but also that in the second circulating path 12 is used for development. Accordingly, the amount of usable developer increases, thus extending the lifetime of the developer.

Moreover, the path for carrying the developer is formed to be a circulatory structure, and in addition to the first circulating path 11 for supplying the developer to the developer carrier 1, the second circulating path 12 is provided, so that the developer can be interchanged between the first circulating path 11 and the second circulating path 12. As a result, a developer that is still usable does not have to be thrown away as in the conventional trickle system. Thus, it becomes possible to use the developer effectively for a long period of time.

As a carrier member of the third carrier passage 23 constituting the second circulating path 12, the spiral coil 9 is used, and its rotational speed is slow. Therefore, a carried amount of the developer in the second circulating path 12 is much smaller than that in the first circulating path 11, so that the developer moves only slightly from the first circulating path 11 to the second circulating path 12 within a certain time period. Consequently, a new toner that is supplied to the first circulating path 11 moves to the second circulating path 12 only slightly, and most of the supplied toner is stirred and charged in the first circulating path 11 and supplied to the developing roller 1*a*. Thus, the second circulating path 12 has only a little influence on the stirring and charging of the developer in the first circulating path 11. Also, an extremely small driving torque should be sufficient for the stirring coil 9.

In addition, since the stirring coil 9 is disposed next to and substantially parallel with the stirring screw 4, the height of the developing device does not have to be increased, and the dimension of the developing device expands only horizontally. In general, it is relatively easy to secure a horizontal space of a developing device in an image forming apparatus, and thus, the developing device of the present embodiment should have little influence on the configuration and size of the entire image forming apparatus.

In the embodiment described above, the new toner is supplied to the first circulating path 11. However, the present invention is not limited to the above, and the toner also may be supplied to the second circulating path 12 (the third carrier passage 23). When supplied to the first circulating path 11, the toner may be supplied to the first carrier passage 21 or the second carrier passage 22 that is common to the first circulating path 11 and the second circulating path 12. Further, the developer may be stirred and carried through the second circulating path 12 either constantly as in the above embodiment or intermittently.

Furthermore, the toner concentrations, that is, the ratios of toner to carrier, of the developers in the first circulating path 11 and the second circulating path 12 may be the same or different. When they are different, it is desirable that the carried amount of the developer in the first circulating path 11 be larger than that in the second circulating path 12 for the purpose of suppressing the variation in toner concentration of the developer in the first circulating path 11.

Second Embodiment

Figure 3:
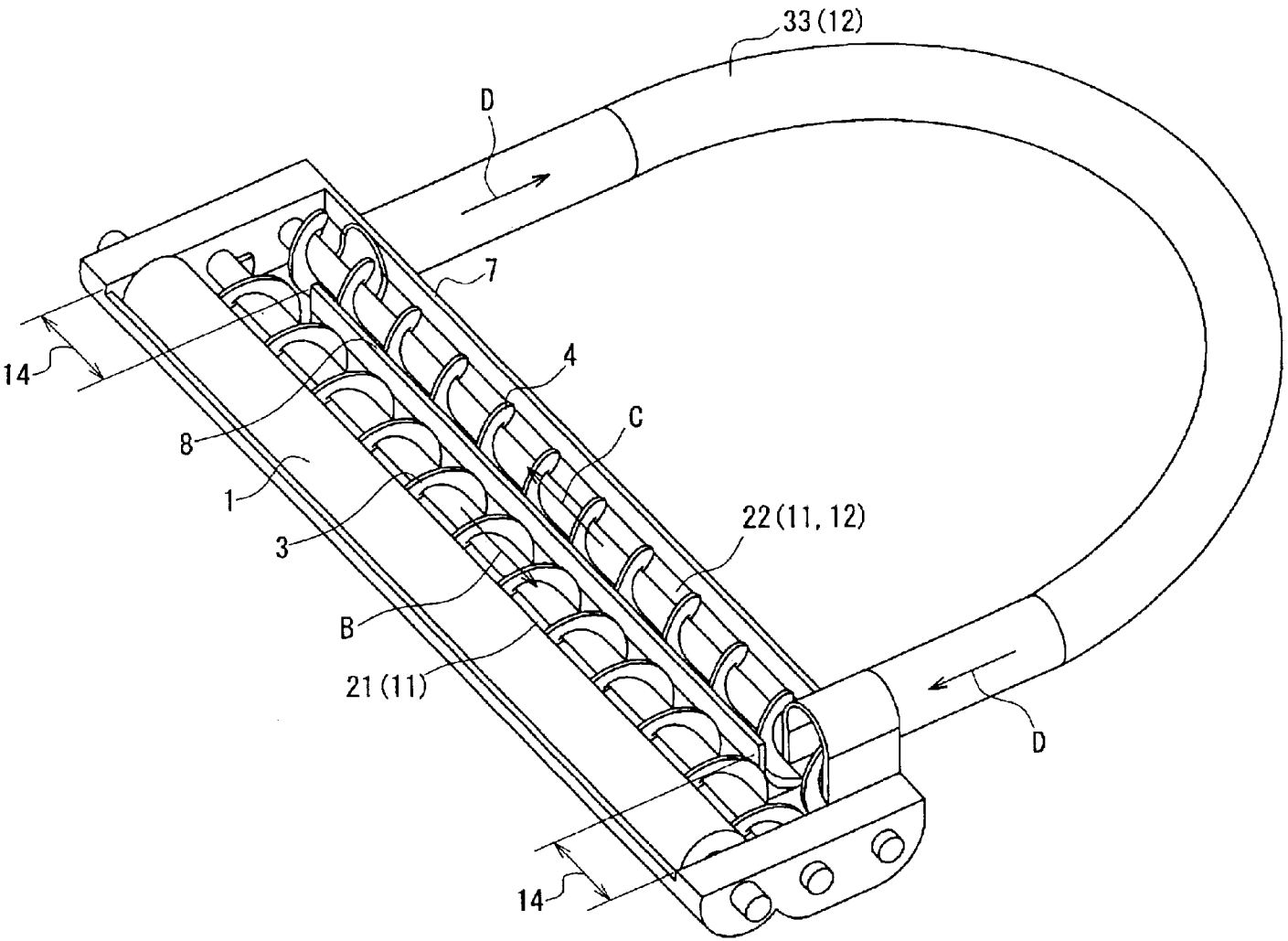
FIG. 3 is a schematic perspective view showing a developing device according to a second embodiment of the present invention.

FIG. 3 is a schematic perspective view of a developing device according to a second embodiment of the present invention. In FIG. 3, members having the same function as those in FIGS. 1 and 2 illustrating the first embodiment are given the same reference numerals, and a further description thereof will be omitted.

The second embodiment is different from the first embodiment in the third carrier passage constituting the second circulating path 12.

In the first embodiment, the third carrier passage 23 having the stirring coil 9 is provided in the developing case 7 so as to lie alongside and parallel to the common second carrier passage 22. On the other hand, in the second embodiment, a third carrier passage 33 is separated from the second carrier passage 22 as shown in FIG. 3. The third carrier passage 33 of the present embodiment is formed of a flexible hollow tube and has a stirring coil that can be bent and deformed (not shown) therein. Openings at both ends of the third carrier passage 33 are connected to both ends of the second carrier passage 22. The stirring coil inside the third carrier passage 33 is rotated and driven by a driving device (not shown), thereby stirring and carrying the developer 2 in a direction indicated by an arrow D.

As in the first embodiment, the present embodiment also forms the second circulating path 12 for circulating the developer 2 in the direction indicated by the arrows C and D while stirring it. The first circulating path 11 and the second circulating path 12 share the common second carrier passage 22 in which the stirring screw 4 is disposed. This can produce an effect similar to that in the first embodiment.

Furthermore, since the third carrier passage 33 is formed of the flexible tube, it is possible to prevent the horizontal dimension of the developing device from expanding and place the third carrier passage 33 within an unoccupied space in the image forming apparatus. Thus, it becomes easier to secure a space for the third carrier passage 33, thereby preventing the image forming apparatus from becoming larger.

Third Embodiment

Figure 4:
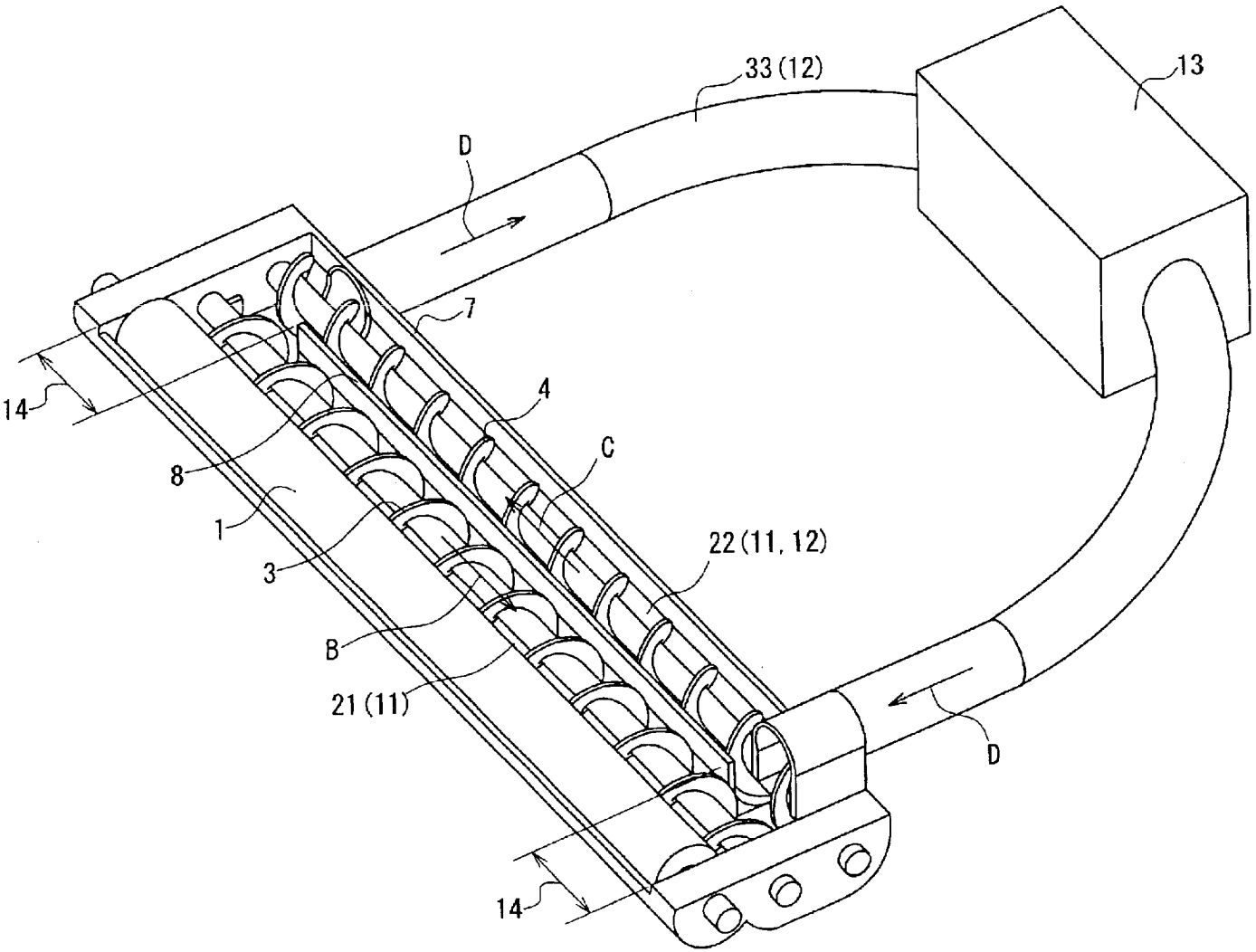
FIG. 4 is a schematic perspective view showing a developing device according to a third embodiment of the present invention.

FIG. 4 is a schematic perspective view of a developing device according to a third embodiment of the present invention. In FIG. 4, members having the same function as those in FIG. 3 illustrating the second embodiment are given the same reference numerals, and a further description thereof will be omitted.

The third embodiment is different from the second embodiment in that a developer container 13 is provided midway along the third carrier passage 33 constituting the second circulating path 12. The developer contained in the developer container 13 is supplied gradually to the third carrier passage 33 according to a consumed amount of the toner.

In accordance with the present embodiment, since the developer container 13 is provided in the third carrier passage 33 so as to increase the developer amount, it is possible to extend further the lifetime of the developer.

In the present embodiment, the developer container 13 may be replaceable by removing it from the third carrier passage 33. This allows an extremely easy replacement of the developer.

Moreover, although the present embodiment is directed to an example of providing the developer container 13 in the developing device shown in the second embodiment, it also may be provided in the developing device shown in the first embodiment.

Fourth Embodiment

Figure 5:
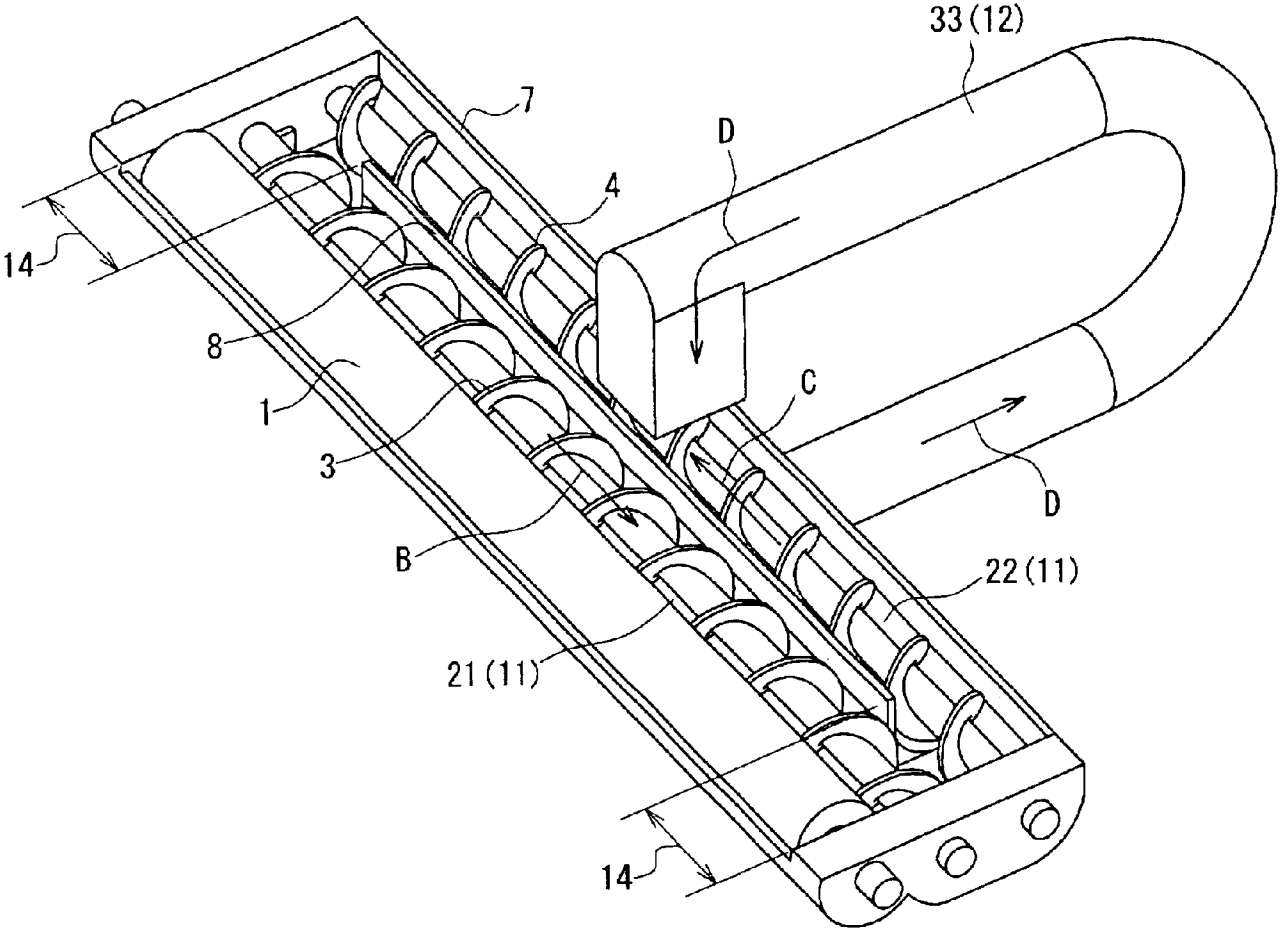
FIG. 5 is a schematic perspective view showing a developing device according to a fourth embodiment of the present invention.

FIG. 5 is a schematic perspective view of a developing device according to a fourth embodiment of the present invention. In FIG. 5, members having the same function as those in FIG. 3 illustrating the second embodiment are given the same reference numerals, and a further description thereof will be omitted.

The fourth embodiment is different from the second embodiment in that openings at both ends of the hollow tube constituting the third carrier passage 33 are provided above and below a position midway along the second carrier passage 22.

In the fourth embodiment, the first circulating path 11 is constituted by the first carrier passage 21, the second carrier passage 22 and the transfer regions 14 that connect the both ends of the first carrier passage 21 and the second carrier passage 22 as in the first to third embodiments, and circulates the developer 2 in the direction indicated by the arrows B and C while stirring it. On the other hand, the second circulating path 12 of the fourth embodiment is constituted by the third carrier passage 33 and circulates the developer 2 in the direction indicated by an arrow D while stirring it, unlike the second embodiment. In other words, the second carrier passage 22 does not constitute the second circulating path 12. Further, the first circulating path 11 and the second circulating path 12 intersect in a portion where the openings at both ends of the hollow tube constituting the third carrier passage 33 are opposed to each other. At this intersection, the developers in the first circulating path 11 and the second circulating path 12 are mixed as in the first to third embodiments. In other words, a part of the developer in the first circulating path 11 moves to the second circulating path 12, whereas a part of the developer in the second circulating path 12 moves to the first circulating path 11, whereby the developers are interchanged. As a result, an effect similar to that in the first embodiment can be obtained. In addition, the third carrier passage 33 is formed of the flexible hollow tube, making it possible to achieve an effect similar to that in the second embodiment.

Fifth Embodiment

Figure 6:
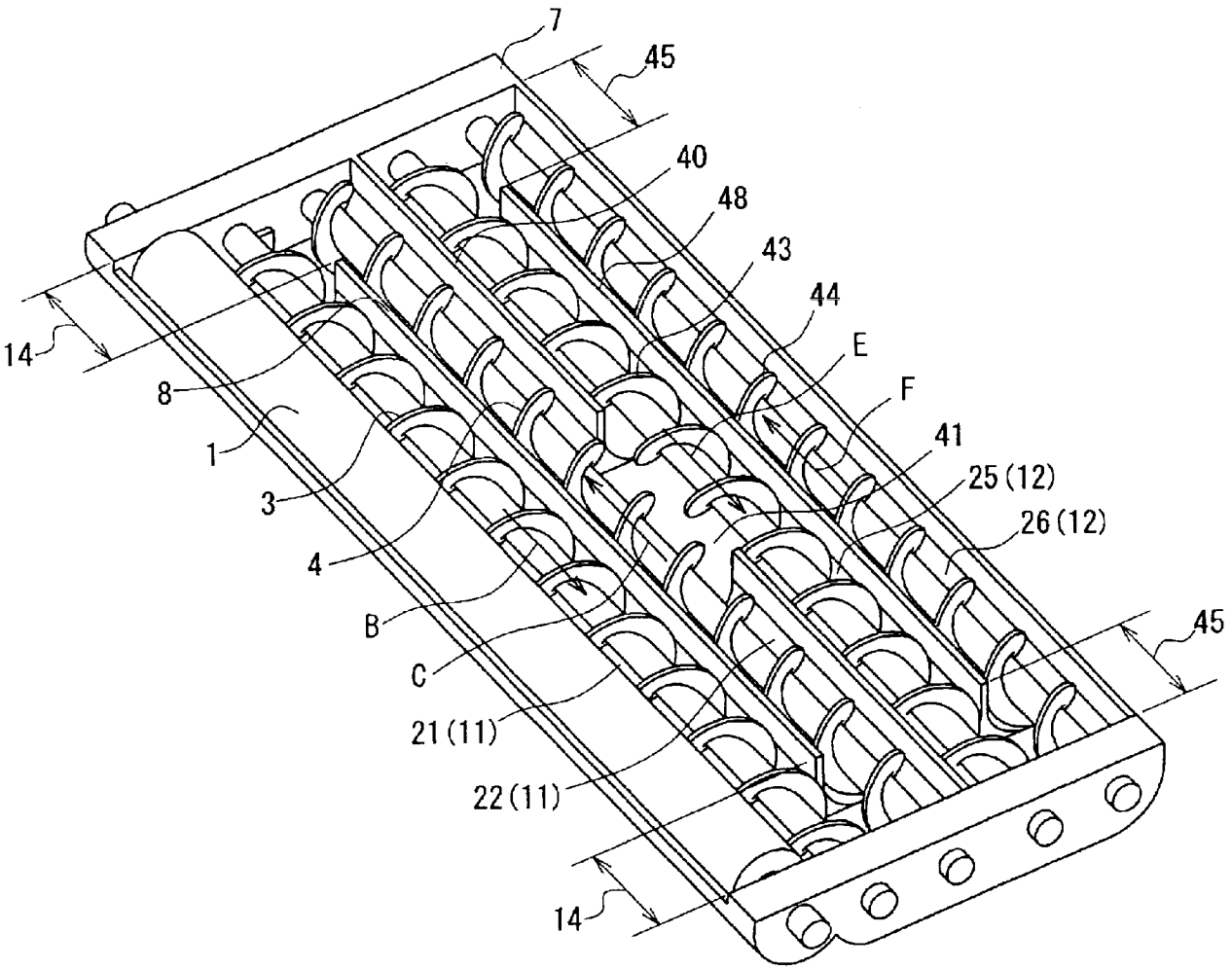
FIG. 6 is a schematic perspective view showing a developing device according to a fifth embodiment of the present invention.
Figure 7:
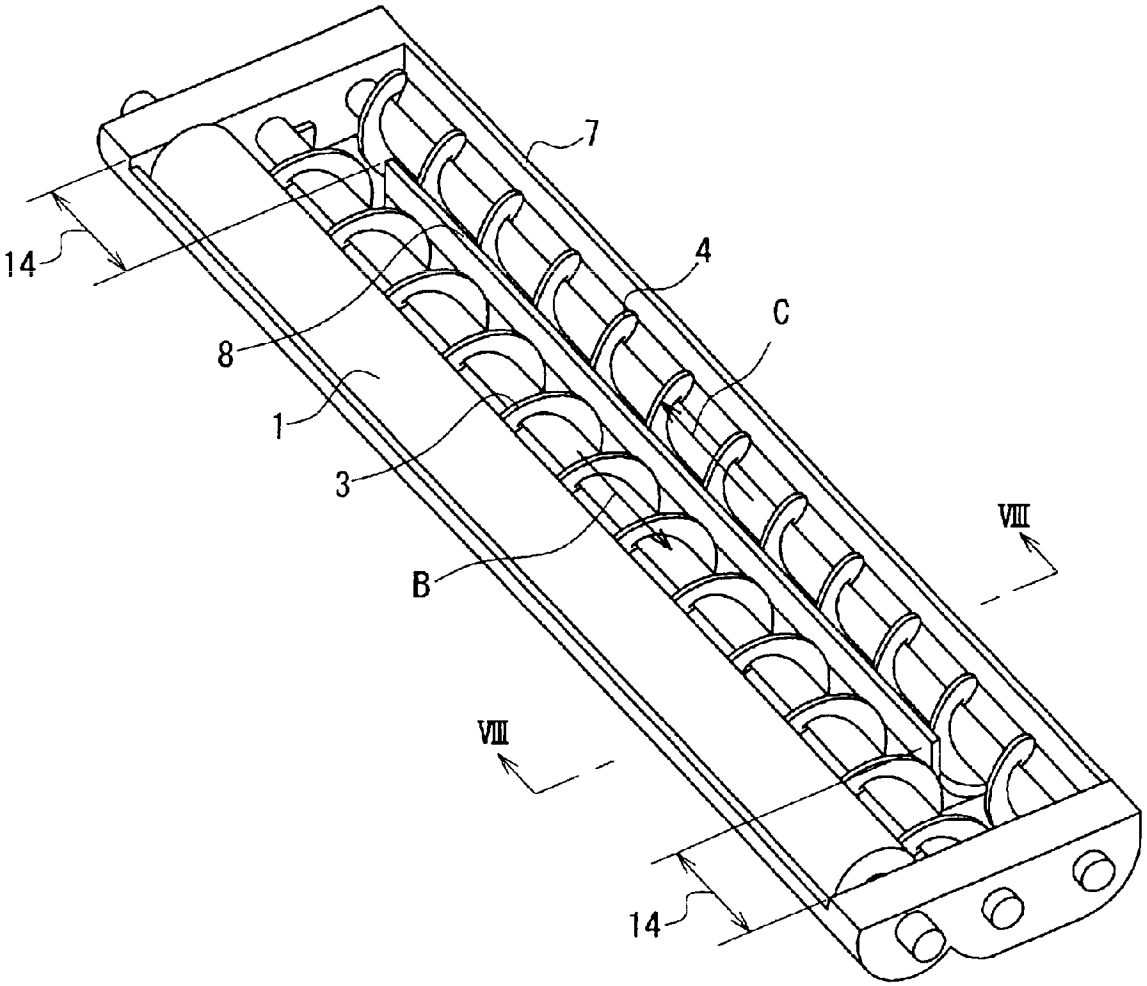
FIG. 7 PRIOR ART
FIG. 7 is a schematic perspective view showing a conventional developing device.
Figure 8:
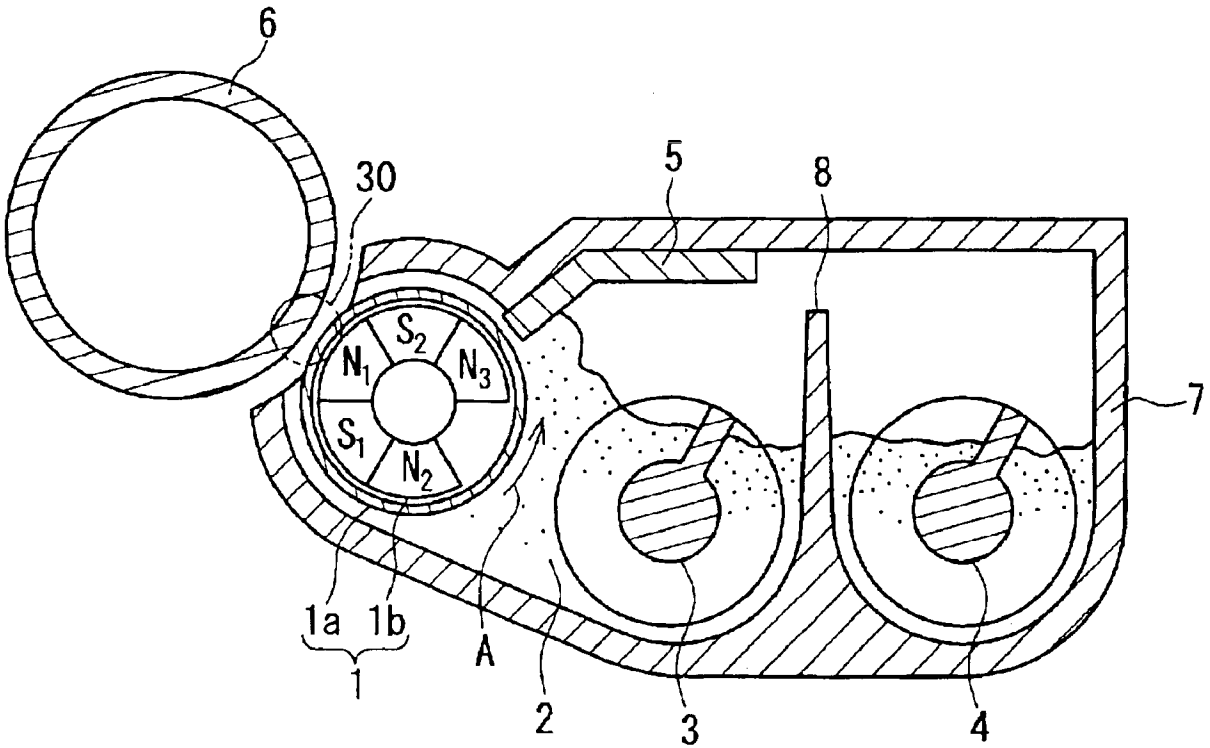
FIG. 8 PRIOR ART
FIG. 8 is a sectional view, taken along a line VIII—VIII and seen in an arrow direction in FIG. 7, showing the conventional developing device.

FIG. 6 is a schematic perspective view of a developing device according to a fifth embodiment of the present invention. In FIG. 6, members having the same function as those in FIGS. 1 and 2 illustrating the first embodiment are given the same reference numerals, and a further description thereof will be omitted.

The fifth embodiment is different from the first embodiment in the following points. First, the configuration of the second circulating path 12 is different. Second, a part of the first circulating path 11 and a part of the second circulating path 12 are common in the first embodiment, whereas they contact each other in the fifth embodiment.

As in the first embodiment, the first circulating path 11 is constituted by the first carrier passage 21, the second carrier passage 22 and the transfer regions 14 that connect the both ends of the first carrier passage 21 and the second carrier passage 22, and circulates the developer 2 in the direction indicated by the arrows B and C while stirring it.

On the other hand, the second circulating path 12 is constituted by a third carrier passage 25, a fourth carrier passage 26 and transfer regions 45 that connect both ends of the third carrier passage 25 and the fourth carrier passage 26, and circulates the developer 2 in direction indicated by arrows E and F while stirring it. The third carrier passage 25 and the second carrier passage 22 lie next to each other between which a partition plate 40 is placed. In the third carrier passage 25 and the fourth carrier passage 26, stirring screws 43 and 44 respectively are arranged in such a manner as to be in parallel with the developer carrier 1. The stirring screws 43 and 44 have similar specifications to the stirring screws 3 and 4, respectively. A partition plate 48 that may be formed as one piece with the developing case 7 and partitions the developer 2 is provided between both of the stirring screws 43 and 44. The stirring screws 43 and 44 are rotated at the same rotational speed by a driving portion (not shown), thereby stirring and carrying the developer 2 along rotating-shaft directions indicated by the arrows E and F, which are opposite to each other. In portions corresponding to both ends of the stirring screws 43 and 44, the partition plate 48 is cut out so as to form the transfer regions 45. The developer 2 can be transferred between the stirring screws 43 and 44 through these transfer regions 45. As a result, the third carrier passage 25 in which the stirring screw 43 stirs and carries the developer 2 in the direction of the arrow E is formed between the partition plate 40 and the partition plate 48, whereas the fourth carrier passage 26 in which the stirring screw 44 stirs and carries the developer 2 in the direction of the arrow F is formed between the partition plate 48 and an inner wall of the developing case 7. Although the stirring screws 43 and 44 rotate at the same rotational speed, their rotational speed is lower than that of the stirring screws 3 and 4. Thus, the carried amount of the developer in the second circulating path 12 is smaller than that in the first circulating path 11.

A central portion of the partition plate 40 between the second carrier passage 22 and the third carrier passage 25 is cut out so as to form a mixing region 41. Through this mixing region 41, the developers in the first circulating path 11 and the second circulating path 12 are mixed. In other words, at the mixing region 41, a part of the developer in the first circulating path 11 moves to the second circulating path 12, whereas a part of the developer in the second circulating path 12 moves to the first circulating path 11, whereby the developers are interchanged. Consequently, an effect similar to that in the first embodiment can be obtained.

Although the developers in the first circulating path 11 and the second circulating path 12 are carried in opposite directions at a contact region (the mixing region 41) of these circulating paths 11 and 12 in FIG. 6, they also may be carried in the same direction. In general, a larger amount of the developer is mixed in the case of the opposite carrying direction.

Furthermore, the position in the partition plate 40 where the mixing region 41 is formed is not limited to the central portion along the longitudinal direction of the partition plate 40 as shown in FIG. 6 but may be at either end. Moreover, the mixing region may be formed in plural positions in the partition plate 40.

In addition, the stirring screws 43 and 44 may be substituted with the stirring coils illustrated in the first embodiment.

The first to fifth embodiments described above are directed to the developing device including the first circulating path 11 for supplying the developer 2 to the developer carrier 1 and the second circulating path 12 provided so that the developer 2 can be interchanged between the first circulating path 11 and the second circulating path 12. However, the number of circulating paths of the developer 2 that can be provided in the developing device of the present invention is not limited to two but may be three or more. For example, it may be possible to add a third circulating path provided so that the developer 2 can be interchanged between the second circulating path 12 and the third circulating path. Furthermore, it also may be possible to form a fourth circulating path provided so that the developer 2 can be interchanged between this third circulating path and the fourth circulating path. In this manner, the total amount of the developer can be increased in keeping with the number of circulating paths that are connected in a chain-like manner to the first circulating path 11 for supplying the developer 2 to the developer carrier 1. Thus, it is possible to heighten further the effect of the present invention that a longer lifetime of the developer can be achieved while suppressing the deterioration of the developer.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A developing device comprising:

a developer carrier that supports and carries a developer to a developing region for developing a static latent image on a latent image carrier;

a first circulating path for carrying and supplying the developer to the developer carrier; and a second circulating path for carrying the developer;

wherein at least a part of the first circulating path and at least a part of the second circulating path are common, the developer carrier is disposed along a path other than a common path of the first circulating path that is shared with the second circulating path, and the developer moves in the path along the developer carrier from one end of the developer carrier toward the other end thereof.

2. The developing device according to claim 1, wherein the developer carrier has a roller shape, a first carrier passage and a second carrier passage that are substantially parallel with a longitudinal direction of the developer carrier are provided in this order from a side of the developer carrier, the developer carrier is disposed in the first carrier passage, and the first circulating path comprises the first carrier passage and the second carrier passage.

3. The developing device according to claim 2, wherein a place where the at least a part of the first circulating path and the at least a part of the second circulating path are common is in the second carrier passage.

4. The developing device according to claim 1, wherein a carried amount of the developer (a weight of the developer that is carried per unit time) in the first circulating path is larger than that in the second circulating path.

5. The developing device according to claim 1, wherein a developer container is provided in the second circulating path.

6. The developing device according to claim 5, wherein the developer container is replaceable.

7. The developing device according to claim 1, wherein the developer moves in the common path from one end of the common path toward the other end thereof.

8. A developing device comprising:

a developer carrier that supports and carries a developer to a developing region for developing a static latent image on a latent image carrier;

a first circulating path for carrying and supplying the developer to the developer carrier; and a second circulating path for carrying the developer, wherein at least a part of the first circulating path and at least a part of the second circulating path intersect or contact each other, the developer carrier is disposed along the first circulating path, and the developer moves in the first circulating path from one end of the developer carrier toward the other end thereof.

* * * * *